United States Patent [19]

Morel et al.

[11] 4,072,597

[45] Feb. 7, 1978

[54] METHOD AND APPARATUS FOR COMPENSATING THE MAGNETIC FIELDS IN ADJACENT ROWS OF TRANSVERSELY ARRANGED IGNEOUS ELECTROLYSIS CELLS

[75] Inventors: Paul Morel, Le Vesinet; Jean-Pierre Dugois, Saint Jean-de-Maurienne, both of France

[73] Assignee: Aluminum Pechiney, Lyon, France

[21] Appl. No.: 739,265

[22] Filed: Nov. 5, 1976

[30] Foreign Application Priority Data

Nov. 28, 1975 France ..... 75 37675

[51] Int. Cl.[2] ..... C25B 9/04; C25C 3/16

[52] U.S. Cl. ..... 204/243 M

[58] Field of Search ..... 204/243 M

[56] References Cited

U.S. PATENT DOCUMENTS 3,756,938 9/1973 Nebell ..... 204/243 M

*Primary Examiner*—John H. Mack
*Assistant Examiner*—H. A. Feeley
*Attorney, Agent, or Firm*—McDougall, Hersh & Scott

[57] ABSTRACT

The invention relates to a method of and an apparatus for compensating the magnetic fields in adjacent rows of transversely arranged igneous electrolysis cells.

In this method, the distribution of current in the conductors feeding the anode of a downstream cell from the cathode of the adjacent upstream cell is modified in such a way as to superimpose upon the cell an electrical loop which produces an additional magnetic field substantially equal to that created by the adjacent row and opposite in direction.

The invention is applicable to the compensation of the magnetic fields of adjacent rows of transversely arranged igneous electrolysis cells and, more particularly, to cells for the production of aluminium.

6 Claims, 7 Drawing Figures

METHOD AND APPARATUS FOR COMPENSATING THE MAGNETIC FIELDS IN ADJACENT ROWS OF TRANSVERSELY ARRANGED IGNEOUS ELECTROLYSIS CELLS

This invention, which is the outcome of research by Messrs. Paul Morel and Jean-Pierre Dougois, relates to a method of and an apparatus for conpensating the magnetic fields of adjacent rows of transversely arranged igneous electrolysis cells.

Aluminium is commercially produced by the igneous electrolysis, in cells electrically connected in series, of a solution of alumina in cryolite heated to a temperature of the order of 950° to 1000° C by the Joule effect of the current flowing through the cell.

Each cell comprises a rectangular cathode forming a crucible, of which the base is formed by blocks of carbon secured to steel bars, so-called cathode bars, which are used to remove the current from the cathode towards the anodes of the following cell.

The anodes, also made of carbon, are secured to rods anchored to aluminium bars, so-called anode bars, fixed to a superstructure which over hangs the crucible of the cell. These anode bars are connected by aluminium conductors, so-called "steps", to the cathode bars of the preceding cell.

The electrolysis bath, i.e. the solution of alumina in cryolite, is situated between the anodes and the cathode. The aluminium produced is deposited onto the cathode, a reserve of aluminium being kept at the base of the cathode crucible.

Since the crucible is rectangular, the anode bars supporting the anodes are in general parallel to its large sides, whilst the cathode bars are parallel to its small sides, so-called cell heads.

The cells are arranged in rows either longitudinally or transversely, depending on whether their large side or their small side is parallel to the axis of the row. The cells are electrically connected in series, the ends of the series being connected to the positive and negative outputs of an electrical sub-station for rectification and regulation. Each series of cells comprises a certain number of rows connected in series, the number of rows preferably being even so as to avoid unnecessary lengths of conductors.

The electrical current which flows through the various conductors: electrolyte, liquid metal, anodes, cathode, connecting conductors, creates considerable magnetic fields. Both in the electrolysis bath and in the molten metal accommodated in the crucible, these fields induce so-called Laplace forces which, on account of the movements which they generate, are harmful to the operation of the cell. The cell and its connecting conductors are designed in such a way that the magnetic fields created by the various parts of the cell and the connecting conductors compensate one-another. Accordingly, the overall result is a cell having, as its plane of symmetry, the vertical plane running parallel to the row of cells and passing through the centre of the crucible.

However, the cells are also subjected to troublesome magnetic fields emanating from the adjacent row or rows.

Hereinafter, the words "upstream" and "downstream" are related to the general direction of the electrical current flowing through the row of cells in question. The "adjacent row" is the row closest to the row in question, whilst the "field of the adjacent row" is the resultant of the fields of all the rows other than the row in question.

The present invention relates to a method of compensating the magnetic fields of adjacent rows of transversely arranged igneous electrolysis cells.

The invention also relates to an apparatus for carrying out this method.

In the method according to the invention, the distribution of electrical current in the conductors feeding the anode of a downstream cell from the cathode of the adjacent upstream cell is modified in such a way as to superimpose upon the cell an electrical loop which produces an additional magnetic field substantially equal to that created by the adjacent row and opposite to it in direction.

By virtue of the apparatus according to the invention, it is possible, in a row of cells comprising at least one apparatus cell and one downstream cell, to compensate the magnetic field of an adjacent row. Each cell comprises at least two anode bars, to which rods secured to the anodes are fixed, and a cathode crucible of which the base is formed by blocks of carbon sealed to cathode bars, the anode bars of the downstream cell being supplied with electrical current from the cathode bars of the upstream cell by at least two steps, namely an inner step, i.e. situated on the side of the adjacent row, and an outer step, each step comprising two conductors of which one is connected to the upstream ends of the cathode bars whilst the other is connected to the downstream ends of the cathode bars. One of the conductors of the inner step, on the upstream side of downstream side, is connected to more than half the corresponding ends of the cathode bars, taken from the inside, the corresponding conductor of the outer step being connected to the outside ends which are not connected to the inner step, whilst the other inner conductor on the downstream or upstream side is connected to the inner half of the correponding ends and the outer conductor corresponding to half the outside.

Embodiments of the invention are described by way of example in the following with reference to the accompanying drawings, wherein:

FIG. 5 is a block diagram whilst FIG. 6 shows a more detailed example of embodiment.

In these Figures, the same elements are denoted by the same reference numerals.

The method for compensating the magnetic fields of adjacent rows of transversely arranged cells enables an electrical loop producing a supplementary field substantially equal to that created by the adjacent row and opposite to it in direction to be superimposed upon the electrolysis cell by a slight modification of the distribution of current in the conductors.

In one series of cells, the design of the connecting conductors may be one of two types.

In the first type, the anode bars of a downstream cell are fed at their ends (end steps).

In a second type, the anode bars of a downstream cell are fed over one quarter and three quarters of their length (central step). In the two types, all or part of the current issuing from the cathode on the upstream side flows around the cell head to feed a step terminating at the following downstream cell. In total, the current flowing through the conductors running along the cell heads normally represents between one quarter and one half the total intensity of the series.

Figure 1:
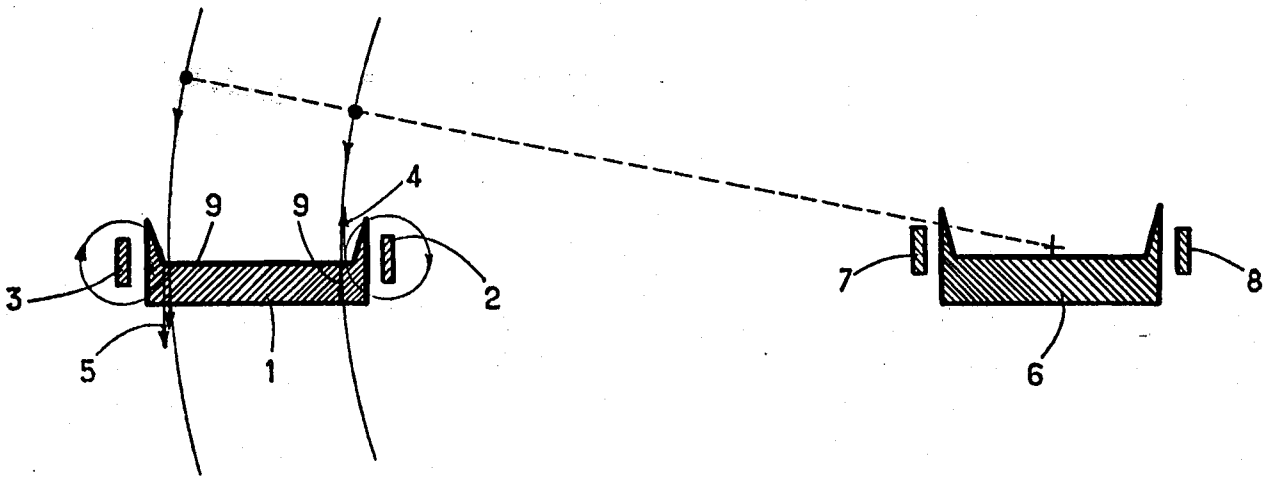
FIG. 1 is a diagram showing the direction of the field created by the adjacent row and by the steps.

FIG. 1 shows a cell 1 of a first row represented by its cathode crucible which is shown in section along a vertical plane perpendicular to the axis of the rows. The anodes (not shown) of this cell 1 are fed by two steps 2 and 3. In the row in question, the current flows away from the observer, the magnetic field produced by the step 2 is denoted by the arrow 4 whilst the magnetic field produced by the step 3 is denoted by the arrow 5.

To the right of this cell there is a cell 6 of the immediately adjacent row which is also represented by its cathode crucible. The anodes (not shown) of this cell are fed by steps 7 and 8. In this row, the current flows towards the observer perpendicularly of the Figure. This cell produces in the cell 1 a vertical magnetic field denoted by the arrow 9.

If the step 2 which runs along the cell 1 on the side of the adjacent cell 6 is referred to as the "inner" cell and if the step 3 on the opposite side is referred to as the "outer" step, it can be seen that the outer step 3 creates in the cell 1 a vertical magnetic field 5 with the same direction as the magnetic field 9 created by the cell 6 of the adjacent row. It also creates a much weaker horizontal magnetic field which will be discussed further on.

In the method according to the invention, the intensity of the current flowing through the outer step 3 is reduced in favour of the inner step 2 which reduces the negative field produced by the outer conductor on the outer small side and increases the positive field 4 created by the inner step 2 on the inner small side. An electrical loop is thus superimposed upon the cell, producing an additional magnetic field superimposed upon the positive field over the greater part of the cell.

A first embodiment of the apparatus will now be described with reference to FIGS. 2 and 3.

These Figures show two transversely arranged adjacent cells belonging to the same row. The upper cell 10 comprises a cathode crucible 11 and a superstructure 12. The base of the crucible 11 is formed by blocks of carbon secured to 12 cathode bars 13 to 24. The downstream cell 25 comprises a cathode crucible 26 and a superstructure 27 comprising two anode bars 28 and 29 to which the anode rods (not shown) are fixed.

These cells are of the end-step type. The upstream ends of six of the 12 cathode bars on the left-hand side, i.e. 13 to 18, are connected in known manner to the corresponding end of the anode bars 28 and 29 of the downstream cell 25 by a conductor 30, and the downstream ends of the same cathode bars 13 to 18 are connected to same end of the anode bars 28 and 29 by a conductor 31, these two conductors 30 and 31 together forming the left-hand step, i.e. the inner step because the adjacent row is assumed to be situated on the same left-hand side. Similarly, the right-hand end of the anode bars 28 and 29 is connected to the upstream ends of the six other cathode bars 19 to 24 by a conductor 32 and to the downstream end of these same cathode bars by a conductor 33, these conductors 32 and 33 together forming the right-hand step i.e. the outer step.

In order to compensate the magnetic field of the adjacent row, situated on the left, the upstream end (FIG. 2) or downstream end (FIG. 3) of the cathode bar 19 situated immediately to the right of the axis 34 is disconnected from its conductor 32 or 33 to connect it to the corresponding conductor 30 or 31 of the left-hand step. The intensity of the current flowing through the inner step 30–31 is thus increased at the expense of the intensity of the current flowing through the outer step, whence the creation of an electrical loop 40.

Figure 2:
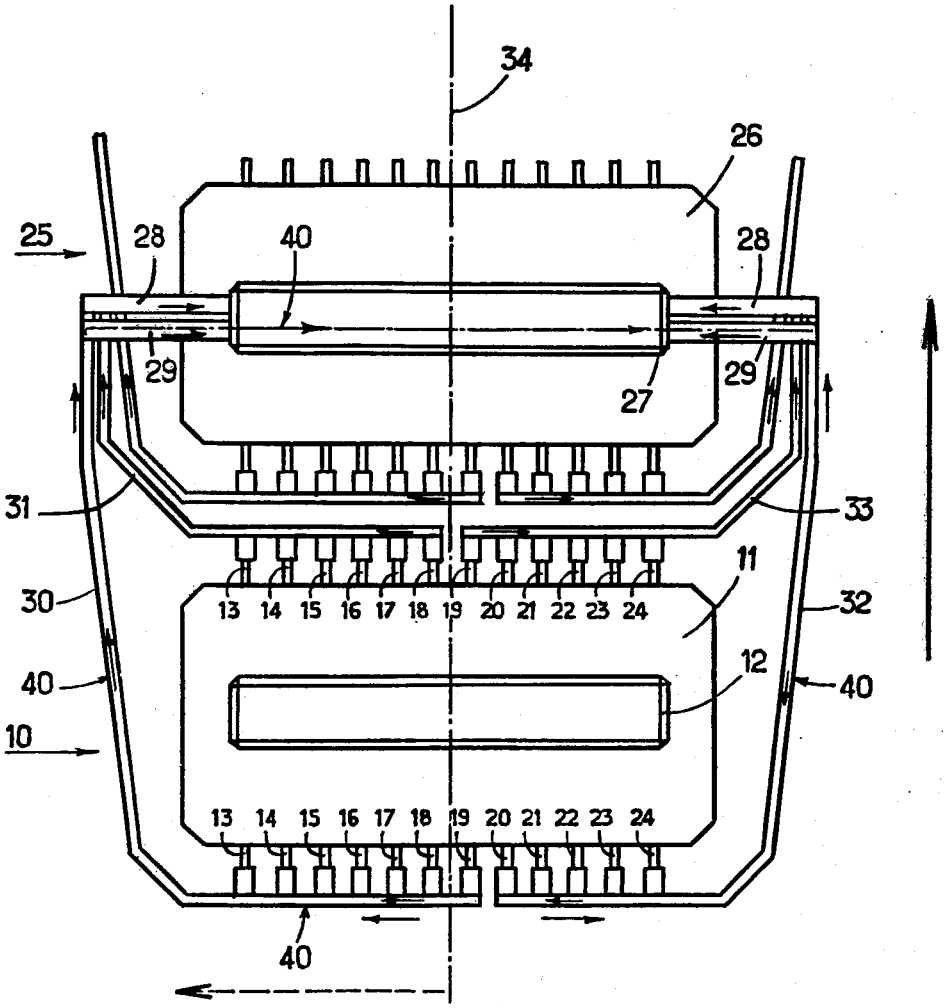
FIG. 2 is a plan view of two cells of one series, the field of the adjacent row being compensated by connecting the first cathode bar of the outer upstream side to the inner upstream conductor.
Figure 3:
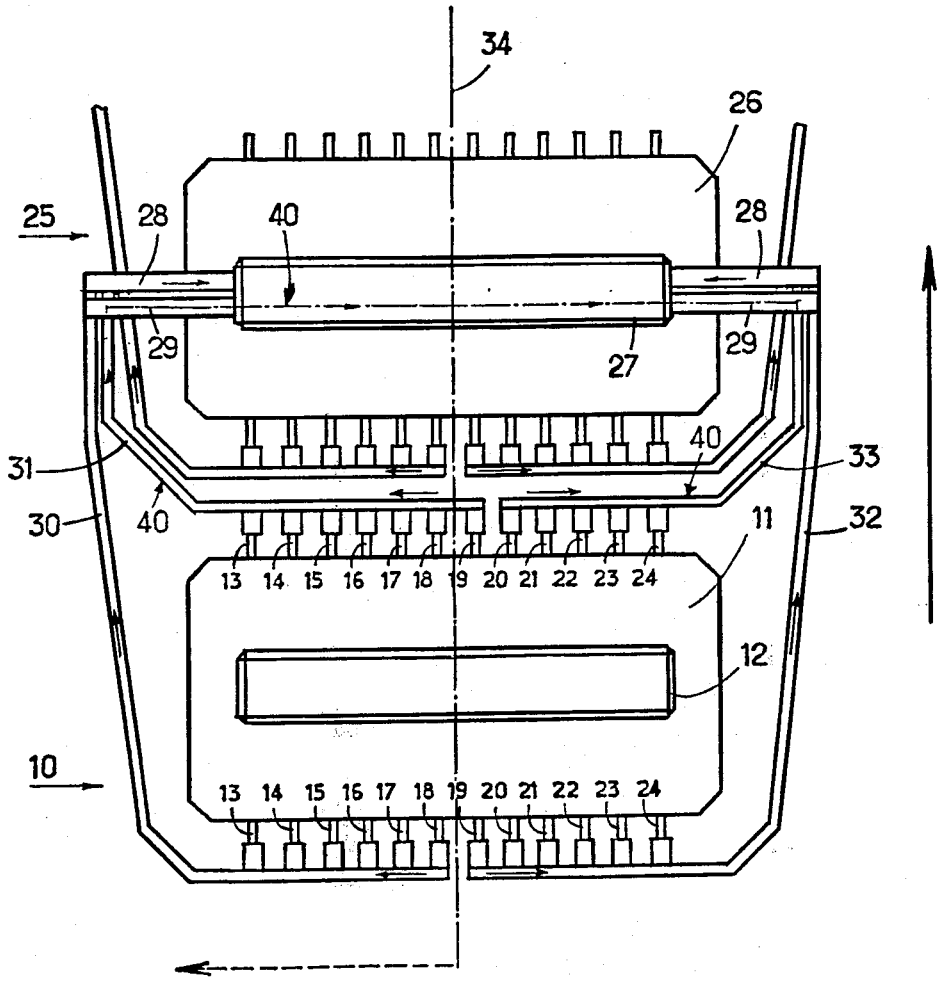
FIG. 3 is a similar view of two cells of one series, the field of the adjacent row being compensated by connecting the first cathode bar of the outer downstream side to the inner downstream conductor.

It is pointed out that the downstream connection shown in FIG. 3 is less effective than the upstream connection shown in FIG. 2 because the downstream conductor 31 – 33 runs only along half the width of the downstream cell 25, whereas the upstream conductor 30 – 32 runs along the entire side of the upstream cell 10 and along half the side of the downstream cell 25. Accordingly, the effectiveness ratio of the two apparatus is thus 1 to 3 in favour of the upstream end.

It is of course possible to connect to the inner conductor the ends of more than one cathode bar, for example those of the two bars 19 and 20 closest to the axis 34 of the series.

The two apparatus described above have the disadvantage of creating a weak transverse horizontal magnetic field of approximately 5 gauss in the case of 90,000 amp cells corresponding to the type described. A third apparatus enables the field of the adjacent row to be compensated without creating any horizontal field in the case of cells with end steps. To this end, a certain number of upstream ends of outer cathode bars adjacent the axis 34, for example (FIG. 4) the upstream ends of the bars 19 and 20, to the inner upstream conductor 30, and the same number of downstream ends of inner cathode bars adjacent the axis 34, for example the downstream ends of the bars 17 and 18, to the outer downstream conductor 33. In this way, it is only the current intensity of the conductors situated in the horizontal plane of the cathode which is modified, so that no horizontal magnetic field is created in the cathode.

However, it can be seen in FIG. 1 that the vertical magnetic fields at the two upstream corners of the cell are opposite in sign whereas the field created by the adjacent row is of constant sign. It follows that the compensation of the field of the adjacent row has a favourable effect in the outer upstream corner, but an unfavourable effect in the inner downstream corner.

Figure 5:
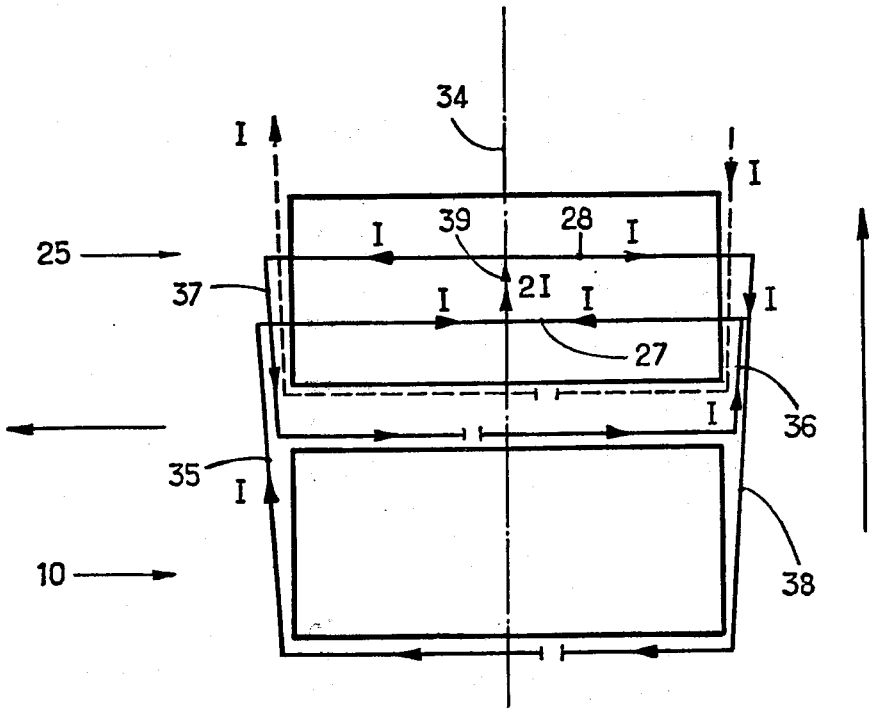
FIGS. 5 and 6 show a compensating apparatus which constitutes a variant of the preceding embodiment.
Figure 6:
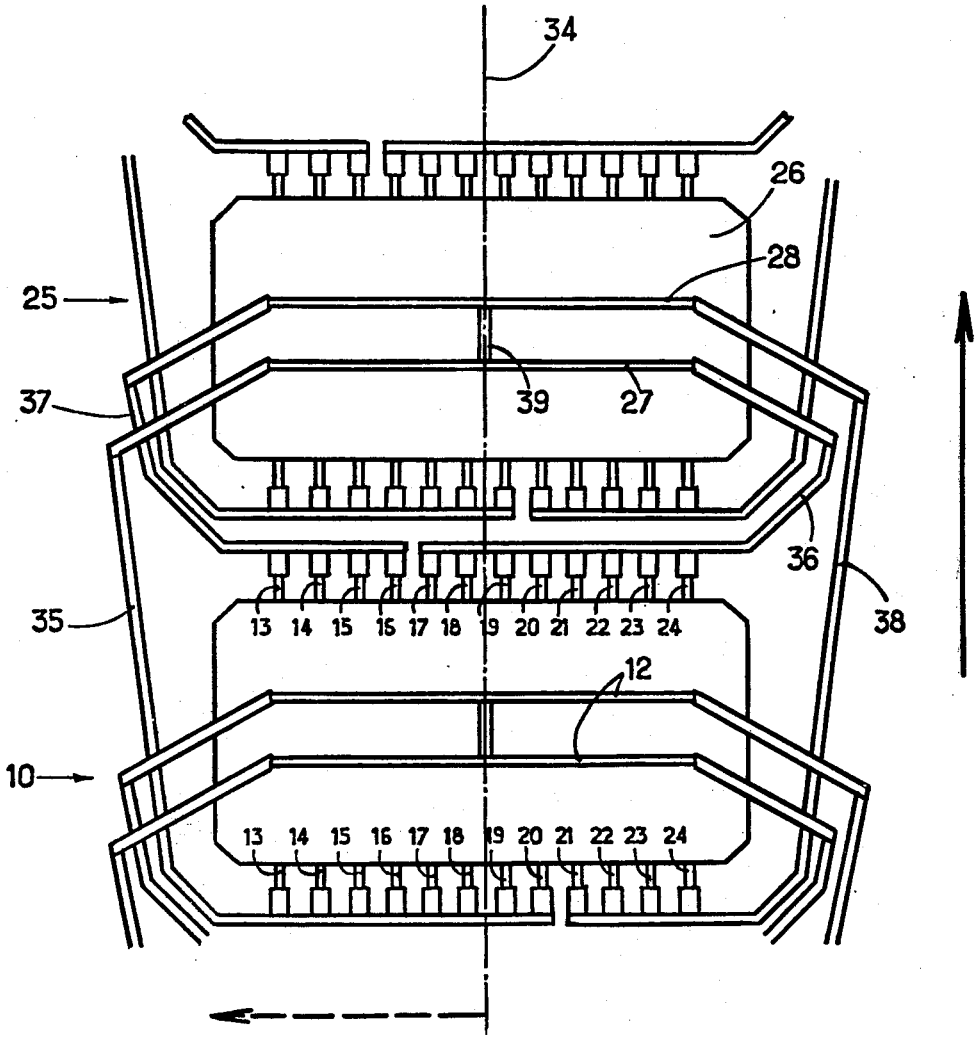

This unfavourable effect is eliminated in a fourth embodiment which is diagramatically illustrated in FIG. 5 and one example of which is illustrated FIG. 6. This embodiment is an improvement in the preceding embodiment in that it provides for greater compensation on the outer side than on the inner side. Instead of symmetrically feeding the anode bars, as in the preceding embodiments, the upstream anode bar being connected to the upstream cathode bars of the upstream cell and the downstream anode bar being connected to the downstream cathode bars, or vice versa, the following procedure is adopted:

The upstream anode bar 27 is connected on the inner side to the upstream cathode bars of the upstream cell by a step 35 and, on the outer side, to the downstream cathode bars of the upstream cell by a step 36;

The downstream anode bar 28 is connected on the inner side to the downstream cathode bars of the upstream cell by a step 37 whilst, on the outer side, it is connected to the upstream cathode bars of the upstream cell by a step 38.

A supplementary conductor 39 connects the two anode bars at their centre.

The cathode bars are grouped in the same way as described above in reference to the third embodiment.

The intensity I of the diverted current is indicated in FIG. 5 and it can be seen that, on the inner side, the current which flows along the cell has the value I outside the anode bars and is zero between them, whereas, on the outerside, the intensity is I outside the andode bars and two I between them. Accordingly, the total compensation is greater on the outer side.

The horizontal field is no longer zero, but it is longitudinal and hence is far less harmful to the operation of the cell than in the first and second embodiments which have a transverse horizontal field at the centre.

The conductors are designed to be electrically balanced, i.e. in such a way that the voltage drops are identical in all the circuits connected in parallel. Thus, the conductors 30 and 32, which are longer than the conductors 31 and 33 have a greater cross section.

It is easy to determine the intensity of the current to be diverted from the outer conductor to the inner conductor so as to create an electrical loop which produces an additional positive vertical field having substantially the same intensity as the negative vertical field created by the adjacent row, because the field is proportional to the intensity of the current. Accordingly, by superimposing the intensities, the corresponding fields are superimposed. Accordingly, it is possible to schematise the circuits described and illustrated in FIGS. 2, 3, 4, and 5 being the superposition of a conventional non-compensated cell and of an electrical loop 40 shown in chain lines. The arrows on these dashes indicate the direction of the current in the loop, the other arrows indicating the direction of the current in the various steps. Superposition of the intensity of the current flowing through the loop and of the intensities of the currents flowing through the various conductors in the case of the non-compensated cell gives the intensity of the resultant current flowing through each of these conductors after compensation.

Accordingly, the intensity of the current to be diverted is calculated by calculating or measuring the field created by the loop defined above independence upon the intensity I of the diverted current which flows through it, by subsequently superimposing this field upon that of the non-compensated cell and finally by varying I until the maximum vertical field of the cell is a weak as possible in terms of absolute value.

In practice, the value of the vertical field at the four corners of the cell is calculated or measured and recorded on a graph as a function of I, and the value $I_o$ of I corresponding to the absolute value of the minimum of the maximum vertical field is directly read off. (see FIG. 7). The electrical connection is then established by connecting a certain number of cathode bars to each circuit so that the intensity I is as close as possible to $I_o$.

Figure 7:
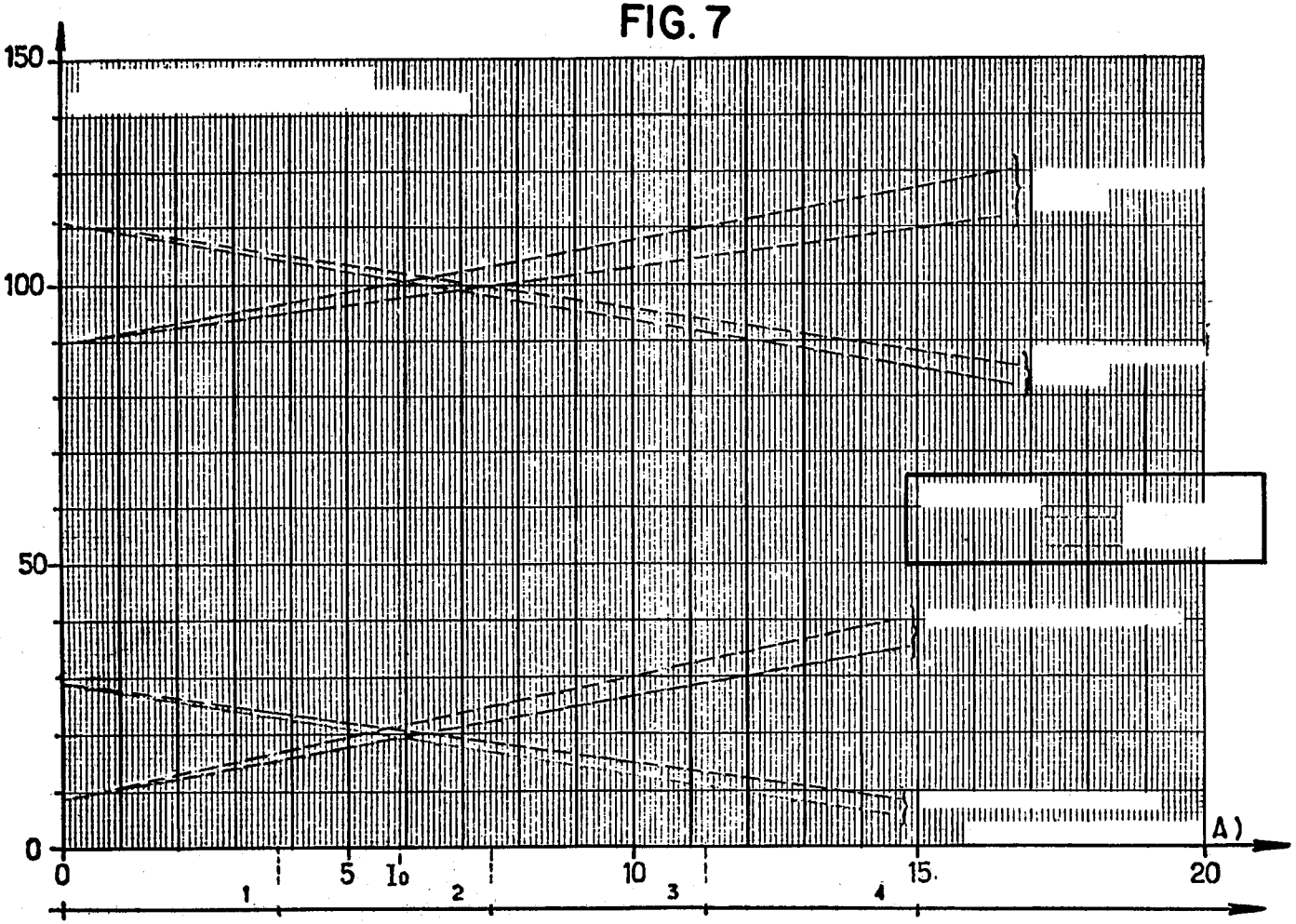
FIG. 7 is a graph showing the magnetic field at the four corners of the crucible in dependence upon the current flowing through the electrical loop.

In FIG. 7, the abscissae represent the diverted intensity in kiloamps and, on the lower horizontal, the number of corresponding bars, whilst the ordinates represent the absolute value in gauss of the magnetic field at the angles, i.e. the corners of the cell. The upper straight lines of positive gradient represent the field in the inner downstream angle, whilst the upper straight lines of negative gradient represent the field in the outer upstream angle. The lower straight lines of positive gradient represent the field at the outer downstream angle, whilst the lower straight lines of negative gradient represent the field at the lower downstream angle. The straight solid lines relate to the embodiment shown in FIG. 4, whilst the chain lines relate to the embodiment illustrated in FIGS. 5 and 6. It can be seen that the optimum value of I is approximately: $I_o = 6\ kA$ : Accordingly the optimum compensation should involve two bars.

The following Table shows, in gauss, the magnetic fields of a 90,000 amp cell without compensation of the field produced by the adjacent row i.e. accordingly FIG. 2, but with the upstream end of the cathode bar 19 connected to the outer conductor 32 and not to the inner conductor 30, or with compensation according to each of the four embodiments described, i.e. in reference to FIGS. 2, 3, 4 and 5–6, respectively. The interval between the rows of cells is 15.5 meters.

Figure 4:
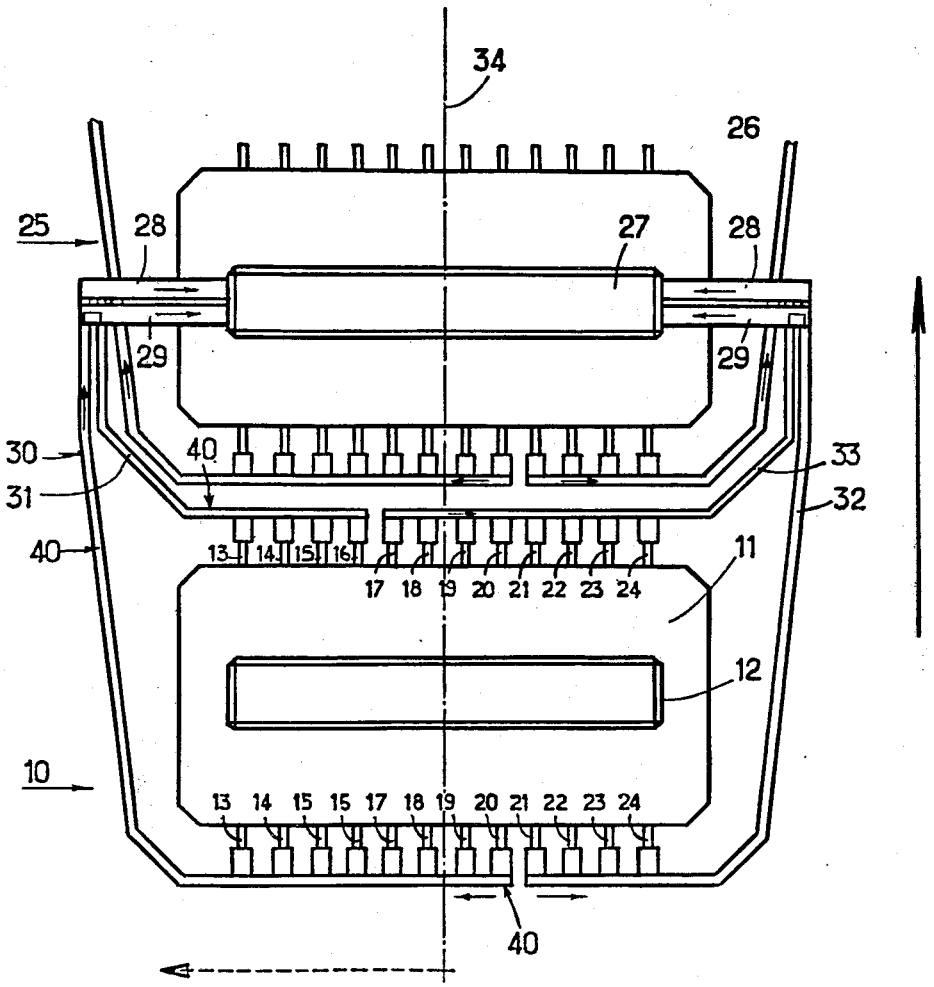
FIG. 4 is another plan view of two cells of one series, the field of the adjacent row being compensated without the creation of a parasitic horizontal field.

The graph shown in FIG. 7 corresponds to the arrangements illustrated in FIG. 4 (solid line) and FIGS. 5 – 6 (chain lines) and to the above parameters.

TABLE

| | | (magnetic field in gauss) | | | | |
|---|---|---|---|---|---|---|
| Magnetic Field | Measuring Zone | Without compensation | First embodiment FIG. 2 | Second embodiment FIG. 3 | Third embodiment FIG. 4 | Fourth embodiment FIGS. 5–6 |
| Vertical | Centre | 10 | 5 | 9 | 2 | 2 |
| | Inner upstream corner | −90 | −103 | −98 | −104 | −100 |
| | outer upstream corner | 111 | 99 | 103 | 98 | 100 |
| | inner downstream corner | 29 | 26 | 31 | 16 | 19 |
| | outer downstream corner | −9 | −12 | −6 | −22 | −25 |
| Horizontal | Centre | 0 | 5 | 5 transversal | 0 | 5 longitudinal |

The embodiments described relate to cells with end steps, although the method and apparatus according to the invention apply equally well to cells with central steps. In this case, the steps are situated at points located at one quarter and three quarters of the length of the cell instead of being situated along its small sides.

The invention is applicable to the compensation of the magnetic fields of adjacent rows of transversely mounted igneous electrolysis cells and, more particularly, to cells for the production of aluminum.

We claim:

1. A method for compensating the magnetic fields of adjacent rows of transversely arranged igneous electrolysis cells wherein the anode of a downstream cell is fed with current from the cathode of the adjacent upstream cell, the current from the cathode being taken off of inner and outer cathode bars, with the inner cathode bars situated on the side of the adjacent row of cells and the outer cathode bars situated on the side opposite to the adjacent row of cells, superimposing an electrical loop which produces additional magnetic fields substantially equal to that created by the adjacent rows and in the opposite direction by increasing the intensity of the current in the conductor situated on the side of the adjacent row and connecting one of the upstream or downstream ends of the cathode bars of the upstream cell to the anode bar of the downstream cell.

2. The method as claimed in claim 1, in which the superimposed electrical loop is created by increasing the intensity of the current in the conductor connecting the upstream end of the inner cathode bars of the upstream cell to the anode of the downstream cell by comparison with the conductor connecting the downstream end of the outer cathode of the upstream cell to the anode.

3. The method as claimed in claim 1 comprising determining the intensity of the current from the outer conductor to the inner conductor to be diverted to create an additional vertical field with substantially the same intensity as the negative vertical field by the adjacent row, wherein the field created by the loop is determined depending upon the intensity of the current in the outer conductor, and superimposing this field upon that of the non compensated cell and varying the current intensity until the maximum vertical field of the cell is at its minimum absolute value.

4. An apparatus for compensating the magnetic fields of adjacent rows of transversely arranged igneous electrolysis cells comprising at least one upstream cell and one downstream cell each cell having at least two anode bars to which rods secured to the anodes are anchored, and a cathode crucible of which the base is formed by blocks of carbon secured to cathode bars, the anode bars of the downstream cell being supplied with electrical current from the cathode bars of the upstream cell by at least two steps including an inner step situated on the side of the adjacent row, and an outer step on the opposite side, each step comprising two conductors of which one is connected to the upstream ends of the cathode bars and the other or is connected to the downstream ends of the cathode bars, wherein one of the conductors of the inner step on the upstream side or downstream side is connected to more than half of the corresponding ends of the cathode bars, taken from the inner side, the conductor corresponding to the outer step being connected to the ends of the cathode bars from the outer side which are not connected to the inner step, while the other inner conductor on the downstream or upstream side is connected to less than half of the cathode bars inside of the corresponding ends and the corresponding outer conductor to less than half the cathode bars on the outer side.

5. An apparatus for compensating the magnetic fields of adjacent rows of transversely arranged igneous electrolysis cells without creating a parasitic horizontal field comprising at least one upstream cell and one downstream cell, in which each cell comprises at least two anode bars to which rods secured to the anodes are anchored, and a cathode crucible of which the base is formed by blocks of carbon anchored to cathode bars, the anode bars of the downstream cell being supplied with electrical current from the cathode bars of the upstream cell by at least two steps, including an inner step, situated on the side of the adjacent row, and an outer step on the opposite side, each step comprising two conductors of which one is connected to the upstream ends of the cathode bars and the other to the downstream ends of the cathode bars, wherein the upstream conductor of the inner step is connected to more than half the upstream ends of the cathode bars, taken from the inner side, the upstream conductor of the outer step being connected to the outside ends of the cathode bars which are not connected to the inner conductor, the outer downstream conductor being connected in the same greater number to half the downstream ends of the cathode bars, taken from the outer side, the inner downstream conductor being connected to the inner downstream ends of the cathode bars which are not connected to the outer downstream conductor.

6. An apparatus as claimed in claim 5, wherein the inner side of the upstream anode bar of the downstream cell is connected on the inner side to the upstream cathode bars and the outer side is connected to the downstream cathode bars of the upstream cell while the inner side of the downstream anode bars of the downstream cell is connected to the downstream cathode bars and the outer side is connected to the upstream cathode bars of the upstream cell, the centers of these anode bars being additionally connected by a conductor.

* * * * *

UNITED STATES PATENT AND TRADEMARK OFFICE

CERTIFICATE OF CORRECTION

PATENT NO. : 4,072,597

DATED : February 7, 1978

INVENTOR(S) : Paul Morel and Jean-Pierre Dugois

It is certified that error appears in the above-identified patent and that said Letters Patent are hereby corrected as shown below:

Column 2, line 19, "apparatus" should be --upstream--

Signed and Sealed this

*Twentieth* Day of *June 1978*

[SEAL]

*Attest:*

RUTH C. MASON
*Attesting Officer*

DONALD W. BANNER
*Commissioner of Patents and Trademarks*

UNITED STATES PATENT AND TRADEMARK OFFICE

CERTIFICATE OF CORRECTION

PATENT NO. : 4,072,597

DATED : February 7, 1978

INVENTOR(S) : Paul Morel et al.

It is certified that error appears in the above-identified patent and that said Letters Patent are hereby corrected as shown below:

On the title page, Item [30], "75 37675" should read --- 75 37674 ---.

Signed and Sealed this

*Twenty-third* Day of *October 1979*

[SEAL]

*Attest:*

RUTH C. MASON
*Attesting Officer*

LUTRELLE F. PARKER
*Acting Commissioner of Patents and Trademarks*